US005460111A

United States Patent [19]

Frahn

[11] Patent Number: 5,460,111

[45] Date of Patent: Oct. 24, 1995

[54] BOAT TRANSOM DRAIN HOLE PLUG

[76] Inventor: Todd R. Frahn, 4224 E. Pratt, Spokane, Wash. 99202

[21] Appl. No.: 371,210

[22] Filed: Jan. 11, 1995

[51] Int. Cl.[6] ..... B63B 13/00

[52] U.S. Cl. ..... 114/197

[58] Field of Search ..... 114/183, 197, 114/198; 220/235

[56] References Cited

U.S. PATENT DOCUMENTS

| | | | |
|---|---|---|---|
| 1,747,933 | 2/1930 | Goodman et al. | 220/235 |
| 2,730,062 | 1/1956 | Mitchell . | |
| 3,394,671 | 7/1968 | Mayer . | |
| 3,797,442 | 3/1974 | McRae | 114/197 |
| 3,859,945 | 1/1975 | Moeller | 114/197 |

*Primary Examiner*—Jesús D. Sotelo
*Attorney, Agent, or Firm*—David S. Thompson

[57] ABSTRACT

A boat plug to seal the hole in a boat's transom is disclosed. The plug provides a flexible rubber stopper having an axial channel that is inserted into the transom hole. A plug bolt and a plug nut are threadedly engaged inside the rubber stopper. A spring rod, attached to the plug bolt, may be rotated by hand to turn the plug bolt on the plug nut's threads. Clockwise rotation shortens the length of the rubber stopper, expanding its diameter to make a water-tight seal. Counter-clockwise rotation causes the rubber stopper to relax, allowing it to be easily inserted or removed from the transom hole. The flexibility of the spring rod allows the user to apply torque while keeping his hand a safe distance from the hull of the boat, thereby avoiding scraped knuckles.

7 Claims, 2 Drawing Sheets

BOAT TRANSOM DRAIN HOLE PLUG

CROSS-REFERENCES

There are no applications related to this application filed in this or any foreign country.

BACKGROUND

A large number of smaller pleasure boats have a removable plug in a hole in a low part of the transom. Such a hole allows the user to drain water from the boat when the boat is removed from the water, or when the boat is moving fast enough that the hole is not exposed to water. The plug is intended to maintain a water-tight seal at other times.

A large number of such plugs provide a generally cylindrical rubber stopper having some type of threaded washer or nut on each end, and an axial bolt. When the plug is inserted into the transom hole, revolution of the bolt forces the stopper to assume a shape having less axial length and a greater diameter. The greater diameter causes the plug's stopper to form a water tight seal in the transom hole.

Using a plug having such a structure provides several problems. First, the transom hole is generally located at the bottom of the transom, immediately above the hull. Such a location allows more water to drain out than would a location higher above the hull. However, turning the bolt, usually by hand manipulation of a T-bar handle, can cause damage to the user's hands, due to friction with the hull. Also, a plug having such a T-bar handle cannot operate where the transom hole is located too low, since the T-bar will contact the surface of the hull, preventing rotation.

A second problem common to most such transom hole plugs is slippage between the stopper and plug nut as the plug bolt is turned by rotating the T-bar handle. When such slippage occurs, rotation of the T-bar rotates both the plug bolt and plug nut; as a result, the plug nut does not move on the threads of the plug bolt.

A third problem commonly encountered in using most transom hole plugs is that, because the transom hole is located so nearly the hull, the bars on the T-bar handle must usually be quite short, and frequently when using a replacement plug the bars must be shortened so that they to not contact the hull as the handle is rotated. As a result, it is difficult to get any leverage when turning the handle, and a tool must sometimes be used.

What is needed is a transom hole plug having means to allow the user to turn the bolt, thus shortening and fattening the stopper, without risk of scraping knuckles on the boat's hull. The stopper must be securely fastened to one element of the threaded fastener, so that when the other threaded element is turned no slippage occurs between the stopper and fastener. The plug must also be adaptable to a variety of boats, having transom holes located a variety of distances above the hull.

SUMMARY

The present invention is directed to an apparatus that satisfies the above needs. A novel plug for a boat's transom drain hole having a handle supported by a spring rod that is flexible enough to protect the user's knuckles is provided.

A preferred version of the boat transom drain hole plug of the present invention provides:

(a) a plug bolt having an end plate and a cylindrical body, the cylindrical body having an axial channel, a portion of the cylindrical body having threads;

(b) a plug nut having an end plate and a collar, the collar being threaded on the inside to thread onto the plug bolt;

(c) a rubber stopper having an axial channel, the stopper carried by the plug bolt and plug nut;

(d) a knob handle having a graspable end and a cylindrical body, the cylindrical body having an axial channel;

(e) a spring rod attached at one end to the axial channel of the plug bolt, and attached at the other end to the axial channel of the knob handle.

The plug nut of the present invention also provides:

(a) spikes attached to the end plate and inserted into the rubber stopper, to prevent rotation of the rubber stopper with respect to the plug nut.

A version of the transom boat plug of the invention is formed from five components. A knob forms the handle, and is crimped to one end of a spring rod. The other end of the spring rod is inserted into a plug bolt, and is also crimped into place. The plug bolt provides a cylindrical body and an end plate. The portion of the cylindrical body opposite the end plate is threaded, to accept a plug nut. The cylindrical body is inserted into the axial channel in a rubber stopper until the end plate comes to rest on the first round end of the cylindrical rubber stopper. A plug nut is provided, having a collar with a threaded inside, sized to be screwed onto the threaded portion of the plug bolt. The plug nut has an end plate attached to the collar in a manner that allows the collar to be screwed onto the plug until the end plate of the plug nut contacts the second end of the rubber stopper. The plug nut's end plate provides several straight cuts that allow a portion of the end plate to be bent in a direction parallel to the collar, to form spikes that may be inserted into the rubber stopper, to prevent movement by the stopper against the plug nut.

In using the boat transom hole plug of the invention, the user simply inserts the rubber stopper into the transom hole. By flexing the spring rod, the user is able to lift his fingers and knuckles away from the hull of the boat, which is usually just below the transom hole. Flexing the spring rod also tends to cause the plug's stopper to make frictional contact with the transom hole. The user then turns clockwise on the knob handle, causing the plug bolt to thread onto the plug nut. This causes the rubber stopper to be squeezed in the lengthwise direction, resulting in an outward bulging. This causes a water-tight seal between the stopper and the boat's transom hole.

It is therefore a primary advantage of the present invention to provide a novel boat transom plug having a spring rod that allows the user to apply torque by hand without scraping knuckles or fingers on the hull of the boat.

Another advantage of the present invention is to provide a novel boat transom hole plug having a plug bolt and a knob handle, each with an axial channel, to allow rapid manufacture by inserting one end of the spring rod into each axial channel and crimping.

A still further advantage of the present invention is to provide a plug nut having an internally threaded collar with a strong threaded connection to the plug bolt and with one or more spikes that engage and hold the flexible stopper, thus preventing the stopper from spinning relative to the plug nut.

DRAWINGS

These and other features, aspects, and advantages of the present invention will become better understood with regard to the following description, appended claims, and accompanying drawings where:

DESCRIPTION

Figure 8:
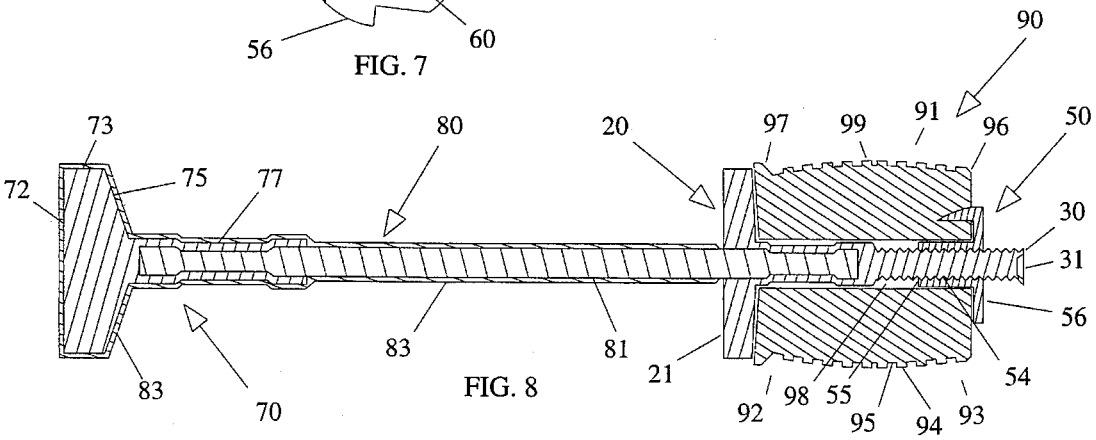
FIG. 8 is a side cross-sectional view of the transom boat plug.
Figure 11:
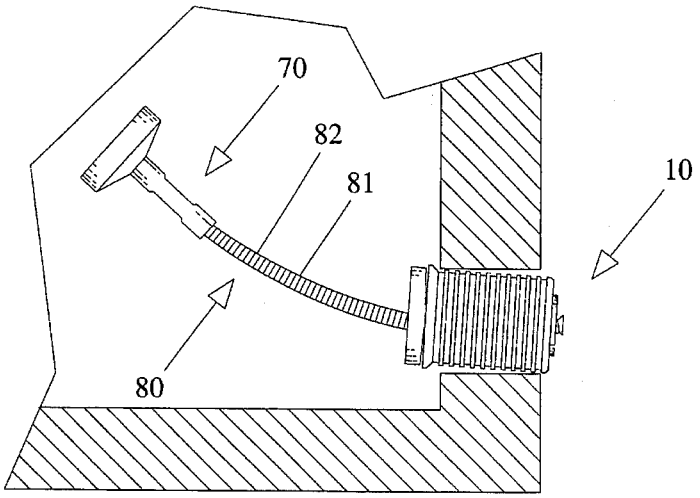
FIG. 11 is a side orthographic view of the transom hole plug inserted into the transom hole prior to increasing the diameter of the stopper.
Figure 12:
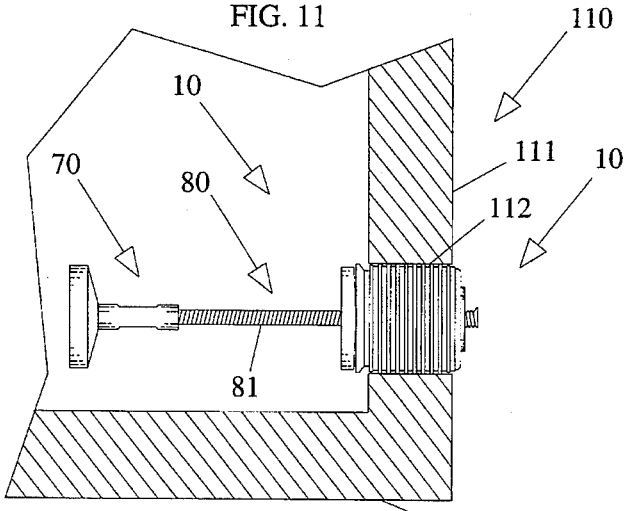
FIG. 12 is the transom hole plug of FIG. 11, with the stopper squeezed to form a water-tight seal with the transom hole.

The present invention is directed to a boat's transom hole plug. With reference to the drawings, and particularly FIGS. 8, 11, and 12, it is seen that the transom hole plug 10 generally provides a knob handle 70, flexible torque delivery means 80, a flexible stopper 90, a plug bolt 20, and a plug nut 50. The transom hole plug 10 is used to plug a hole 112 in a transom 111 of a boat 110. The plug 10 is easily removable, so that water may be drained from the boat, particularly when the boat is removed from water, and easily returned into position. The plug 10 provides the convenience of a torque delivery means comprising a spring rod 81, which allows the user to keep his hand from being scraped on the hull 113.

Figure 6:
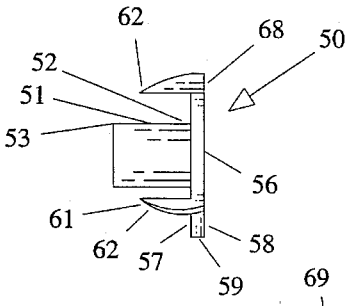
FIG. 6 is a side orthographic view of the plug nut of FIG. 1.
Figure 7:
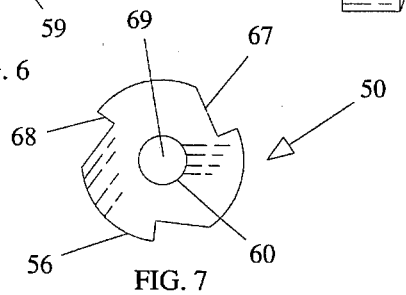
FIG. 7 is an end orthographic view of the plug nut of FIG. 6, as seen from the right side of FIG. 6.

A plug nut 50 is seen in both FIGS. 6 and 7. The plug nut comprises a collar 51 and an end plate 56. The collar 51 has an inner end 53, an outer end 52, and a rim 55. The inside of the collar provides threads 54, which are sized to thread onto the threaded portion 28 of plug bolt 20. The end plate 56 is formed of sheet metal, and provides an inner surface 57, an outer surface 58, and a edge 59 that is formed of segments of a circle. A central hole 60 in the end plate 56 is sized to provide an axial cavity 69 that is co-linear with the collar 51.

The plug nut 50 also provides some type of frictional engagement means 61 for preventing movement between the plug nut and the stopper 90. In FIGS. 6 and 7, the frictional engagement means is shown to comprise three spikes 62. Each spike 62 is formed by making a straight cut 67 in the end plate 56. A bend 68 in the end plate generally perpendicular to the cut 67 is then made, causing the spike 62 to be directed perpendicular to the end plate 56, in a direction parallel to the collar 51, as seen in FIG. 6.

Figure 1:
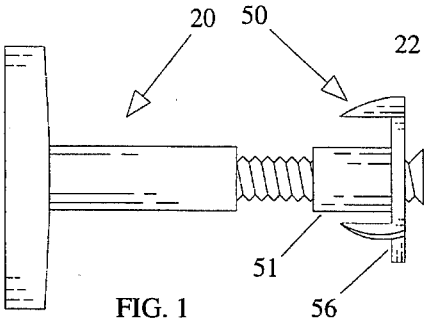
FIG. 1 is an orthographic side view of the plug bolt and plug nut.
Figure 2:
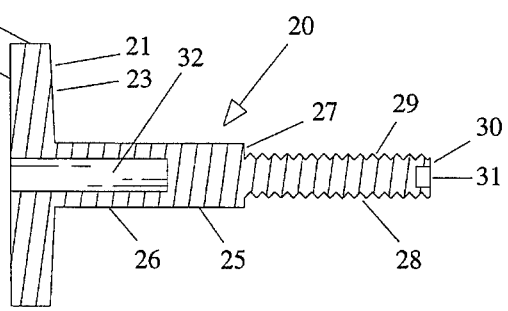
FIG. 2 is a side cross-sectional view of the plug bolt of FIG. 1.
Figure 3:
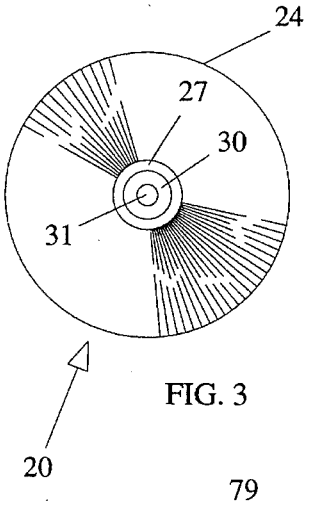
FIG. 3 is an end orthographic view of the plug bolt of FIG. 2, as viewed from the right side of FIG. 2.

As seen in FIGS. 1, 2, and 3, a plug bolt 20 provides an end plate 21 and a cylindrical body 25. The end plate 21 provides an outer side 22, an inner side 23, and a cylindrical edge 24. The diameter of the end plate 21 is generally about the same as the diameter of the stopper 90. The cylindrical body 25 provides a crimp area 26 adjacent to an axial channel 32. The channel 32 is usually approximately one inch in length, and is usually formed by drilling through the outer side 22 of the end plate 21, as seen in FIG. 2. A shoulder 27 separates the cylindrical body 25 from the threaded body portion 28 having threads 29, as seen in FIG. 2. A rim 30 encircles a small drilled hole 31, as seen in both FIGS. 2 and 3. The small drilled hole 31 is generally about one fourth of an inch deep, and allows the end of the threaded body portion 28 to be deformed by a small hammer or other tool. The plug bolt 20 is generally made of aluminum, and may formed by use of a lathe and a thread-making tool.

Figure 4:
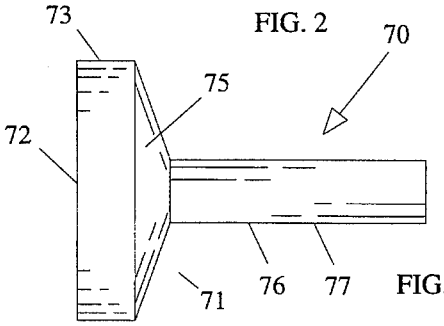
FIG. 4 is a side orthographic view of the knob handle.
Figure 9:
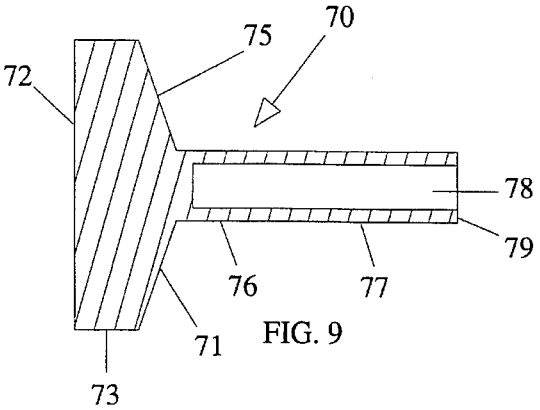
FIG. 9 is a side cross-sectional view of the knob handle of FIG. 4.
Figure 5:
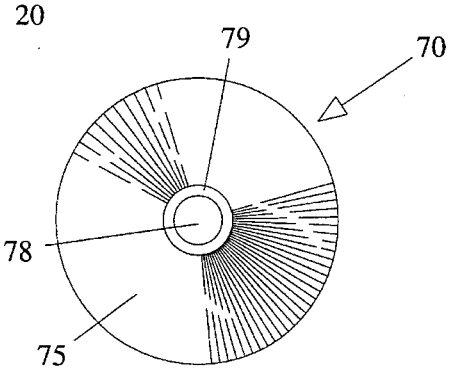
FIG. 5 is an end view of the knob handle, as seen from the right side of FIG. 4.

Referring to FIGS. 4, 5, and 9 the knob handle 70 provides a graspable end 71 and a cylindrical body 76. The graspable end 71 provides a round end surface 72 and a cylindrical edge surface 73. The cylindrical edge surface 73 may optionally be covered by a knurled surface (not shown), to increase the friction and grip.

The end view of FIG. 5 and the cross-sectional view of FIG. 9 show the axial channel 78 of the knob handle 70. The axial channel 78 is typically formed by drilling at an angle perpendicular to the round end surface 72. The length of the axial channel 78 is generally around an inch, but may be any depth that allows the spring rod 81 to be adequately crimped in place, as will be described. A crimp area 77 is seen in FIG. 4, and is the area where a crimp tool may be attached to made a crimp connection between the spring rod 81 and the axial channel 78. A rim 79 is formed at the end of the cylindrical body 76, around the axial channel 78.

As seen in the cross-sectional view of FIG. 9, a conical surface 75 is typically provided, particularly where the knob 70 is made by using a lathe. The conical surface 75 serves as a transition between the cylindrical surface 73 and the cylindrical body 76. The knob handle is typically formed of aluminum, but may be formed of other materials, as desired.

Flexible torque delivery means 80 comprises a spring rod 81, as seen in FIGS. 8, 11, and 12. The spring rod may be formed of a segment of a speedometer cable, or similar wire-stranded cable, having wire strands 82, as seen in FIG. 11. Such a cable is particularly well-suited to transmitting rotary torque. Alternatively, the flexible torque delivery means 80 may comprise the flexible drive shafts common to some heavy-duty "weed-eater" type weed cutters, or various types of brake cables.

Reference to FIGS. 11 and 12 reveals the usefulness of the spring rod 81. In FIG. 11 the spring rod is in a raised position, as if supported by a user's hand, although for clarity the hand is not shown. The spring rod may be bent until there is approximately a ninety degree angle between the cylindrical body 25 of the plug bolt 20 and the cylindrical body 76 of the knob handle 70. With this angle or less, it is possible for the user to turn the knob handle 70, causing the plug bolt 20 to turn. The spring rod 81 also tends to keep the stopper 90 frictionally engaged with the hole 112 in the transom.

Figure 10:
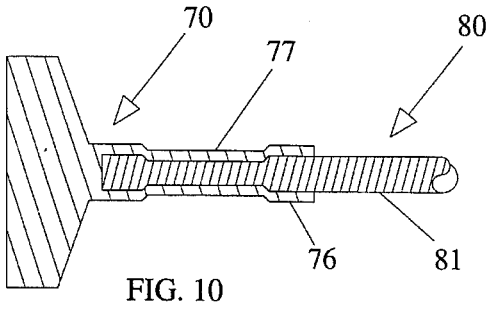
FIG. 10 is a side cross-sectional view of the knob handle of FIG. 9 crimped to the spring rod.

As seen in FIG. 10, the spring rod is connected to the knob handle by means of crimping. FIG. 10 shows the deformity 77 in the cylindrical body 76 of the of the knob handle 70 made by a standard crimping tool. Friction between the spring rod 81 inside of the axial channel 78 and the cylindrical body 76 keeps the body 76 firmly attached to the spring rod 81. The compression shown in FIG. 10 is somewhat exaggerated, to show the principle involved.

A rubber-like, highly frictional surface covering 83 may be provided to cover the spring rod 81 and the knob handle 70. Such a frictional surface covering 83 has the advantages of providing protection against rust and corrosion, and also tends to protect the covered surfaces from mechanically caused dents and dings that may result from contact between the spring rod or knob handle and the hull of the boat. A rubber-like covering may also make the handle 70 more comfortable for the user to turn, and may increase the user's ability to turn the handle in wet conditions due to the frictional nature of the surface covering. Moreover, such a covering 83 may increase the overall attractiveness of the plug 10. The frictional surface covering is flexible enough that it conforms to the outer shape of the spring rod 81, even when that rod is bent during use. Such a rubber-like surface covering may be formed by dipping the handle and spring rod into a product such as COLOR GUARD™ distributed by the Permatex Corporation of Newington, Conn. 06111, a subsidiary of Locktite Corporation. Once dipped in the COLOR GUARD™ product, the plug is allowed to dry. The surface should require no further attention from either manufacturer or user.

A flexible rubber stopper 90 is seen in FIGS. 8, 11, and 12 and is mounted on the plug bolt 20 and the plug nut 50. The stopper 90 is of a type well-known among manufacturers of boat transom hole plugs, and may be made of any suitable rubber or plastic material that offers water resistance, abrasion resistance, and a highly frictional surface. The flexible stopper must be sized appropriately for the transom hole. The stopper provides a body 91 is generally cylindrical in shape, and should usually be incrementally smaller in diameter than the transom hole 112 when in its relaxed state. The body provides an inner end 92 seen adjacent to the end plate 21 of the plug bolt 20 in FIG. 8, and an outer end 93 adjacent to the inner side 57 of end plate 56 of the plug nut 20. An axial channel 98, seen in FIG. 8, is incrementally greater in diameter than the cylindrical body 25 of the plug bolt 20 and the collar 51 of the plug nut 50. A plurality of ribs 94 and between rib indentations 95 tend to make a water-tight seal with the hole 112. A tapered outer end 96, best seen in FIG. 8, makes the stopper 90 easier to insert into the hole 112. A flared inner end 97 tends to prevent the stopper 90 from being inserted too far into hole 112.

The transom boat plug is assembled by first inserting a first end of the spring rod 81 into axial channel 78 of the knob handle 70. A crimp is made, joining rod 81 and knob 70, as seen in FIG. 10. A second end of the spring rod 81 is then inserted into the axial channel 32 of the plug bolt 20, and a second crimp connection is made with a crimping tool, connecting the rod 81 and plug bolt 20.

Next, the threaded body portion 28 of the plug bolt 20 is inserted into the inner end 92 side of the axial channel 98 of the flexible stopper 90. The plug bolt 20 is inserted until the end plate 21 contacts the inner end 92 of the stopper 90. The inner end 53 of the collar 51 of the plug nut 50 is then threaded onto the end-most threads 28 of the plug bolt 20. The tips of the spikes 62 will then contact the outer end 93 of the flexible stopper 90. Gripping the stopper 90 while rotating the knob handle 70 clockwise drives the spikes 62 into the stopper. When the end plate 56 of the plug nut 50 contacts the outer end 93 of the stopper 90, the stopper is in position.

Assembly is completed by peening the small bored hole 31 of the plug bolt 20 with a small hammer. FIG. 2 shows the small bored hole 31 prior to peening, while FIGS. 1 and 8 show the same hole 31 after peening. The result, as seen in FIG. 1, is that the threads near rim 30 are sufficiently deformed that the plug nut 50 will not fall off the end of the threaded portion 28 of the bolt 20.

The transom hole plug 10 is used virtually continuously when the boat is on the water, because the plug is required to keep water from entering the boat. However, since the front of a boat moving sufficiently rapidly is pointed somewhat upwardly, some boaters will open the transom hole and let the water drain out the rear of the boat while in motion. The plug must then be replaced, while the boat is at sufficient speed to prevent the entry of water. When the boat is removed from water, particularly for extended periods of time in the off-season, the plug 10 is frequently removed to allow rain water to drain. The plug is then replaced at the start of the boating season.

The plug 10 may be installed in the transom hole 112 by first inserting the tapered outer end 96 of flexible stopper 90 of the plug into the transom hole. The spring rod is then positioned in a curved manner, as seen in FIG. 11, allowing the user to more easily turn the knob handle. The bias of the spring rod 81 will tend to force the lower portion of the outer end 93 of flexible stopper 90 to contact the hole 112, and will also force the upper portion of the inner end 92 of the flexible stopper to contact the hole 112, as seen in FIG. 11. This contact provides sufficient friction that rotation of the knob handle 70 turns the plug bolt 20 relative to the plug nut 50, rather than turning the stopper 90 relative to the hole 112.

Turning the handle 70 clockwise causes the end plate 21 of the plug bolt 20 to move closer to the end plate 56 of the plug nut 50, as the plug nut moves on the threads 28 of the plug bolt 20. Movement of the plates 21, 56 toward each other squeezes the flexible stopper 90, decreasing somewhat its axial length. This action tends to increase the diameter of the stopper 90, creating the bulge 99, seen in FIGS. 8 and 12. As the bulge forms, the ribs 94 of the stopper are forced against the hole 112, forming a water-tight seal.

The plug 10 may be removed from the transom hole 112 by counterclockwise rotation of the knob handle 70. Counterclockwise rotation causes the end plates 21, 56 to move further apart, relaxing the bias squeezing the flexible stopper 90. This causes the stopper 90 to resiliently assume the shape seen in FIG. 11, where it is not biased against the walls of the transom hole 112.

The previously described invention has many advantages, including a flexible torque delivery means to allow the user to turn the plug nut 50 on the plug bolt 20 while maintaining the back side of the hand used a safe distance from the hull of the boat, thus preventing skin abrasion and scraping. Another advantage of the present invention is that the collar 51 of the plug nut 50 tends to provide a superior connection to the threads 29 of the plug bolt 20, as a result of the length of the collar. A still further advantage of the present invention is that the axial channels 32 and 78 of the plug bolt and knob handle are well-suited for crimping to the spring rod 81, which provides inexpensive and sturdy means of construction.

Although the present invention has been described in considerable detail and with reference to certain preferred versions, other versions are possible. For example the spikes 62 may be replaced by some type of tabs, and still function in a similar manner to prevent rotation between the end plate 56 of the plug nut 50 and the flexible stopper 90. Similarly, the spring rod 81 may be replaced by many types of brake or throttle cables. Therefore, the spirit and scope of the appended claims should not be limited to the description of the preferred versions contained here.

What is claimed is:

1. A boat plug for closing the hole in a boat's transom, comprising:

(a) a plug bolt comprising:

(a) a body having a threaded body portion;

(b) an end plate;

(c) a crimp area on the body; and (d) axial channel means for allowing a first end of a spring rod to be inserted into the plug bolt and for allowing the crimp area to be crimped, thereby attaching the plug bolt to the spring rod;

(b) a plug nut having a collar, the collar threaded on the inside, the collar carried on the threaded body portion of the plug bolt;

(c) a flexible stopper having an axial channel, the stopper carried by the body of the plug bolt;

(d) a knob handle; and (e) torque delivery means, attached to the plug bolt and to the knob handle, for turning the plug bolt with respect to the plug nut and for allowing the user to move the knob handle away from the hull of the boat, comprising:

(a) a flexible spring rod having a first end and a second end.

2. The boat plug of claim 1, in which the spring rod and the knob handle are covered by a highly frictional covering.

3. The boat plug of claim 1, in which the plug bolt additionally comprises:

(a) a small bored hole in the end of the body opposite the end plate, the small bored hole having been peened, thereby preventing the plug nut from being disengaged completely from the plug bolt.

4. The boat plug of claim 1, in which the knob handle comprises:

(a) a graspable end; and (b) a cylindrical body having a crimp area and an axial channel, the second end of the spring rod inserted into the axial channel and the crimp area crimped, thereby attaching the knob handle to the spring rod.

5. The boat plug of claim 1, in which the plug nut comprises:

(a) an end plate having an inner surface and an outer surface;

(b) an outer end portion on the collar, the outer end portion attached to the end plate of the plug nut; and (c) frictional engagement means, attached to the end plate of the plug nut, for preventing rotation between the end plate of the plug nut and the flexible stopper.

6. The boat plug of claim 5, in which the frictional engagement means comprises:

(a) a cut in the end plate of the plug nut;

(b) a bend in the end plate of the plug nut, the bend being generally perpendicular to the cut; and (c) a spike.

7. A boat plug for closing the hole in a boat's transom, comprising:

(a) a plug bolt comprising:

(a) an end plate;

(b) a cylindrical body having a threaded body portion and a crimp area;

(c) an axial channel; and (d) a small bored hole in the end of the body opposite the end plate;

(b) a plug nut, threadedly engaged to the plug bolt, the plug nut comprising:

(a) an end plate;

(b) a collar having a threaded inside, the threads sized to engage the threads of the threaded body portion of the plug bolt, the collar also having an outer end, the outer end attached to the end plate of the plug nut; and (c) a spike attached to the end plate of the plug nut;

(c) a flexible stopper having an axial channel through which the cylindrical body of the plug bolt and the collar of the plug nut pass;

(d) a flexible spring rod, the spring rod having a first end and a second end, the first end crimped into the axial channel of the plug bolt; and (e) a knob handle, attached to the second end of the spring rod.

* * * * *